US008468956B2

(12) United States Patent
Parizek et al.

(10) Patent No.: US 8,468,956 B2
(45) Date of Patent: Jun. 25, 2013

(54) COLLAPSIBLE TRANSACTION TABLE

(75) Inventors: Scott Parizek, Lakeville, MN (US); Dixon Gimpel, Prior Lake, MN (US)

(73) Assignee: Skyline Displays, Inc., Eagan, MN (US)

( * ) Notice: Subject to any disclaimer, the term of this patent is extended or adjusted under 35 U.S.C. 154(b) by 544 days.

(21) Appl. No.: 12/727,128

(22) Filed: Mar. 18, 2010

(65) Prior Publication Data

US 2010/0236457 A1 Sep. 23, 2010

Related U.S. Application Data

(60) Provisional application No. 61/162,025, filed on Mar. 20, 2009.

(51) Int. Cl.
*A47B 57/00* (2006.01)

(52) U.S. Cl.
USPC ..... 108/64; 108/41; 108/157.16; 108/175; 108/179; 312/5; 312/203; 312/258

(58) Field of Classification Search
USPC ..... 108/34–35, 41, 64, 167, 170–171, 108/173, 175, 179, 157.16, 158.12; 312/4–6, 312/195, 203, 258
See application file for complete search history.

(56) References Cited

U.S. PATENT DOCUMENTS

| | | | | |
|---|---|---|---|---|
| 925,314 | A * | 6/1909 | Durand | 108/41 |
| 1,455,569 | A * | 5/1923 | Caminoni, Jr. | 108/41 |
| 2,771,334 | A * | 11/1956 | Wahlbom | 312/140.2 |
| 3,208,807 | A * | 9/1965 | Becker | 312/200 |
| 3,588,209 | A * | 6/1971 | Nathan | 312/140.2 |
| 4,740,010 | A * | 4/1988 | Moskovitz | 280/641 |
| 5,044,595 | A | 9/1991 | Carr et al. | |
| 5,865,127 | A | 2/1999 | Carter | |
| 5,882,098 | A * | 3/1999 | Brown et al. | 312/258 |
| 6,026,751 | A * | 2/2000 | Tsai | 108/34 |
| 6,125,769 | A * | 10/2000 | Tsai et al. | 108/34 |
| 6,145,800 | A | 11/2000 | Watkins | |
| 6,240,855 | B1 | 6/2001 | Pirkl et al. | |
| 6,257,153 | B1 | 7/2001 | Portugal | |
| 6,443,481 | B1 | 9/2002 | Stravitz et al. | |
| 6,848,371 | B2 * | 2/2005 | Zheng | 108/165 |
| 6,851,564 | B2 * | 2/2005 | Ng | 211/149 |

(Continued)

FOREIGN PATENT DOCUMENTS

| | | |
|---|---|---|
| DE | 20012511 | 2/2001 |
| EP | 1208777 A1 | 5/2002 |

(Continued)

*Primary Examiner* — Hanh V Tran
(74) *Attorney, Agent, or Firm* — Thomas J. Oppold; Larkin Hoffman Daly & Lindgren Ltd.

(57) ABSTRACT

To provide a usable workspace for use at tradeshows, conventions and similar events, a collapsible transaction table is uniquely designed to provide transportability and flexibility regarding its setup. In its collapsed condition, the transaction table itself is contained and thereby easily transportable. In its expanded condition, components are provided to provide a usable transaction table which preferably sits at a countertop height but with which also may be modified to further extend into a countertop configuration. To achieve the counter top configuration, a pair of transaction tables are coupled with one another utilizing specifically configured bridging elements to thus create a stable and usable countertop. The transaction tables themselves include a collapsible base unit and tabletop elements which are removably attachable to the base units in an interlocking manner to provide additional stability.

19 Claims, 18 Drawing Sheets

U.S. PATENT DOCUMENTS

| | | | | |
|---|---|---|---|---|
| 7,101,000 | B2 | 9/2006 | DeMars | |
| 7,168,372 | B2 | 1/2007 | Fotia | |
| 7,526,841 | B2 * | 5/2009 | Lipniarski | 24/297 |
| 8,015,928 | B2 * | 9/2011 | Chen | 108/35 |
| 2004/0238469 | A1 | 12/2004 | Ng | |
| 2005/0258723 | A1 | 11/2005 | Chung | |
| 2008/0017083 | A1 | 1/2008 | VanNimwegen et al. | |
| 2009/0031664 | A1 | 2/2009 | Gimpel et al. | |
| 2009/0032349 | A1 | 2/2009 | Ceballos-Godefroy et al. | |

FOREIGN PATENT DOCUMENTS

| | | | |
|---|---|---|---|
| EP | 1535535 | | 6/2005 |
| EP | 1535535 | A2 | 6/2005 |
| WO | WO2007114774 | A1 | 10/2007 |
| WO | 2008047230 | | 4/2008 |
| WO | WO2008047230 | A1 | 4/2008 |
| WO | 2008062286 | | 5/2008 |
| WO | WO2008062286 | A2 | 5/2008 |
| WO | WO2008062286 | A3 | 5/2008 |
| WO | 2008072088 | | 6/2008 |
| WO | WO2008072088 | A1 | 6/2008 |
| WO | 2008096266 | | 8/2008 |
| WO | WO2008096266 | A1 | 8/2008 |

* cited by examiner

14

12

11

COLLAPSIBLE TRANSACTION TABLE

CROSS-REFERENCE TO RELATED APPLICATIONS

This application claims the benefit of previously filed U.S. Provisional application 61/162,025, filed Mar. 20, 2009 and entitled "Collapsible Transaction Table".

BACKGROUND

Tradeshows and exhibitions and the furnishings used by exhibitors at those events, such as displays, tables, counters, chairs, etc. are typically easily transported, easily erected, easily collapsed, and are relatively lightweight.

The space available to an exhibitor may vary from event to event, thus it is generally desirable to have furnishings that are configurable to varying lengths. In addition, it is generally desirable to have furnishings that are esthetically pleasing and which provide surfaces on which to display logos and images of the exhibitor's products or services. Further, it is typically desirable to provide concealed storage areas within the display area in which the exhibitor can keep extra marketing materials and other supplies out of sight of visitors. In addition, it is generally desirable to provide tradeshow furnishings which are adaptable to support accessories or appurtenances for the display of products and promotional materials.

DETAILED DESCRIPTION

Figure 1:
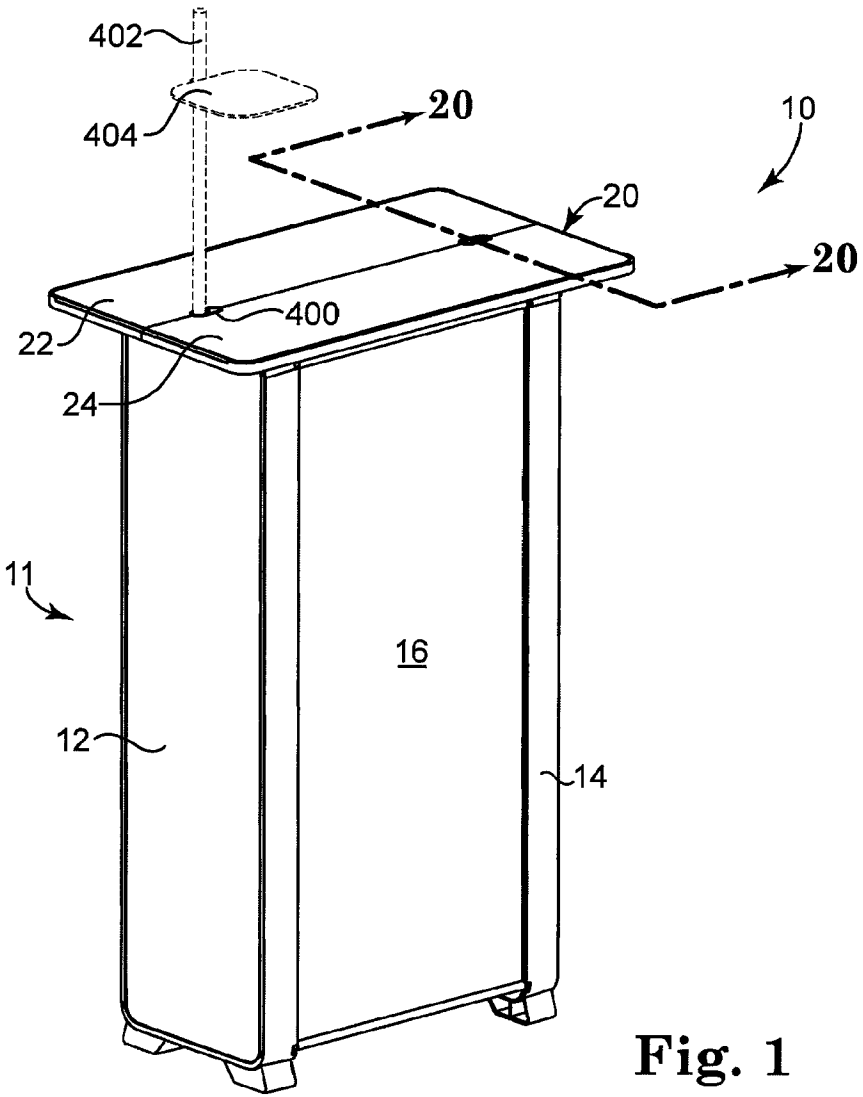
FIG. 1 is a top front perspective view of an embodiment of a collapsible transaction table in an erected configuration.
Figure 2:
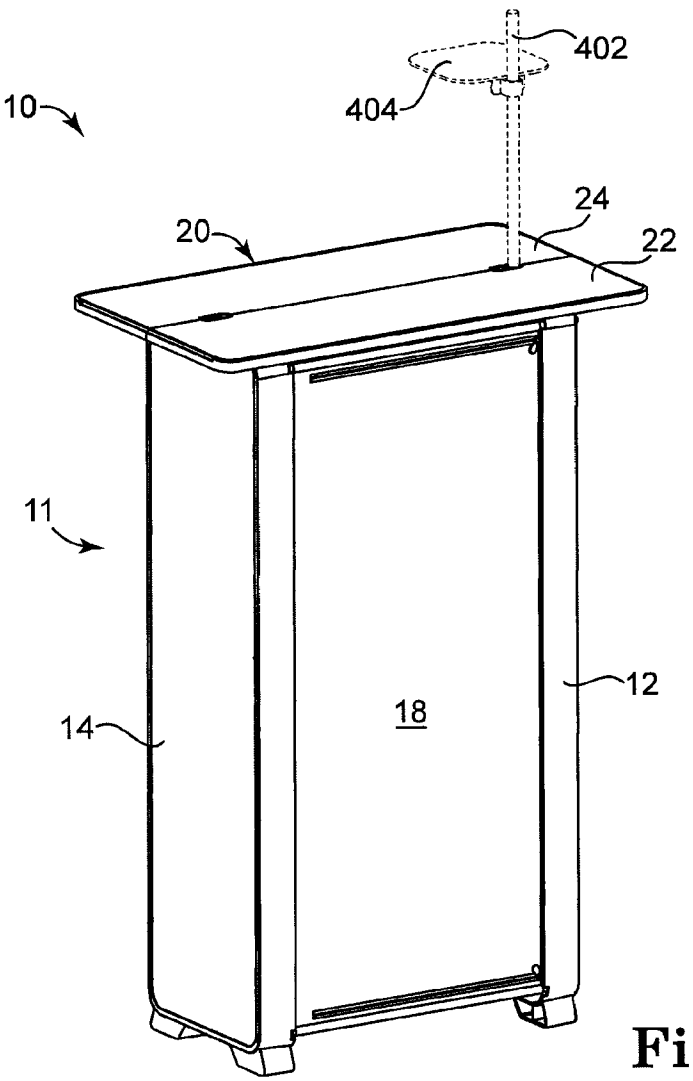
FIG. 2 is a top rear perspective view of the collapsible transaction table of FIG. 1.
Figure 6:
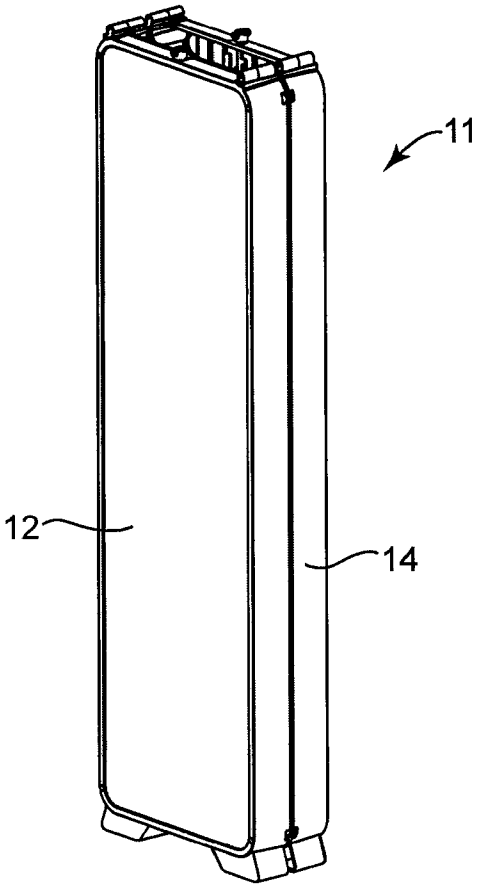
FIG. 6 is a top front perspective view of the transaction table base of FIG. 1 in a collapsed configuration.

Referring now to the drawings, wherein like reference numerals designate identical or corresponding parts throughout the several views, FIGS. 1 and 2 are front and rear perspective views, respectively, of an embodiment of a collapsible transaction table designated generally by reference numeral 10 shown in the fully erected display configuration. FIG. 6 is a front perspective view of the transaction table 10 of FIG. 1 shown in the fully collapsed transport configuration.

Figure 3:
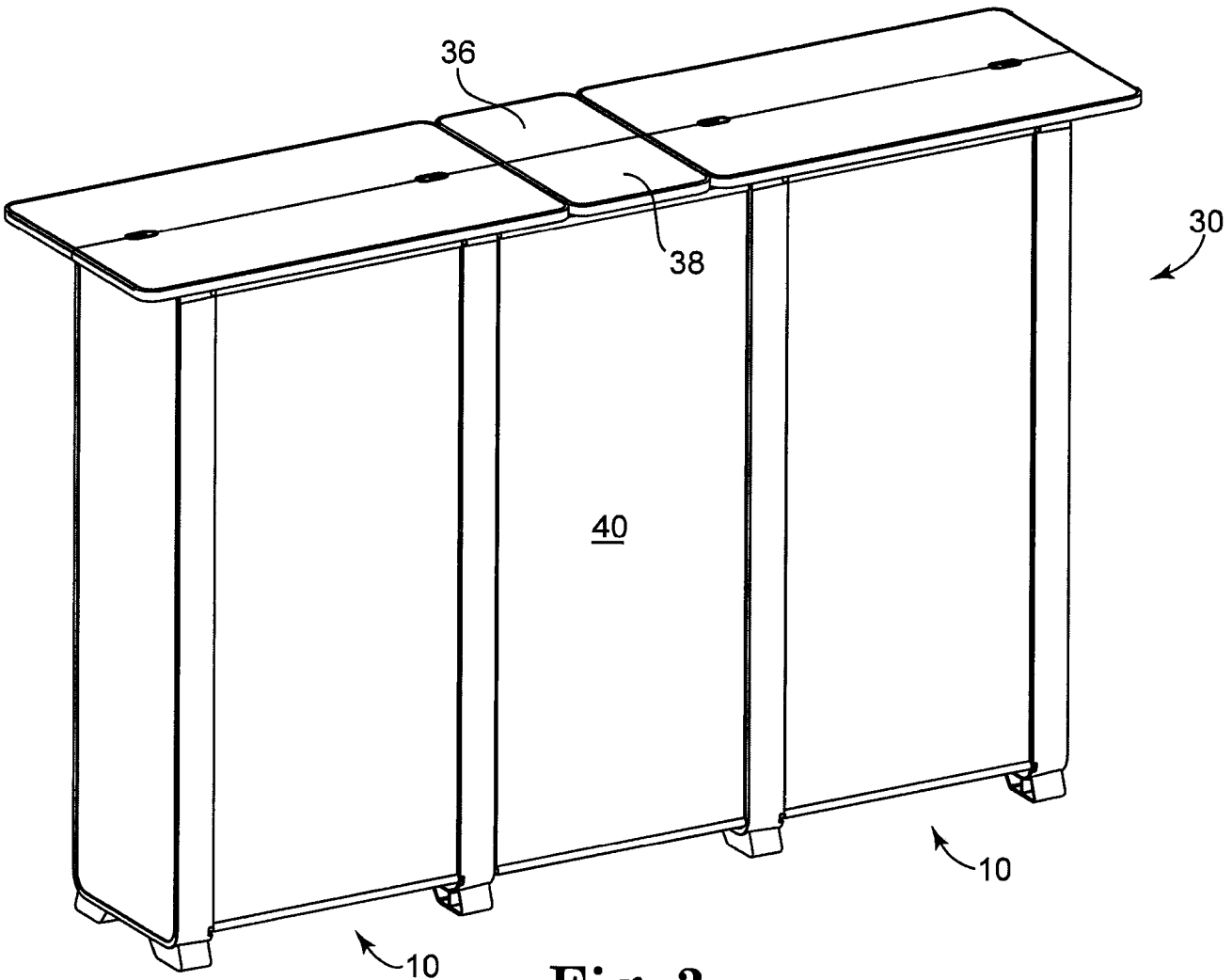
FIG. 3 is top front perspective view showing adjacent collapsible transaction tables of FIG. 1 connected to form a counter.
Figure 4:
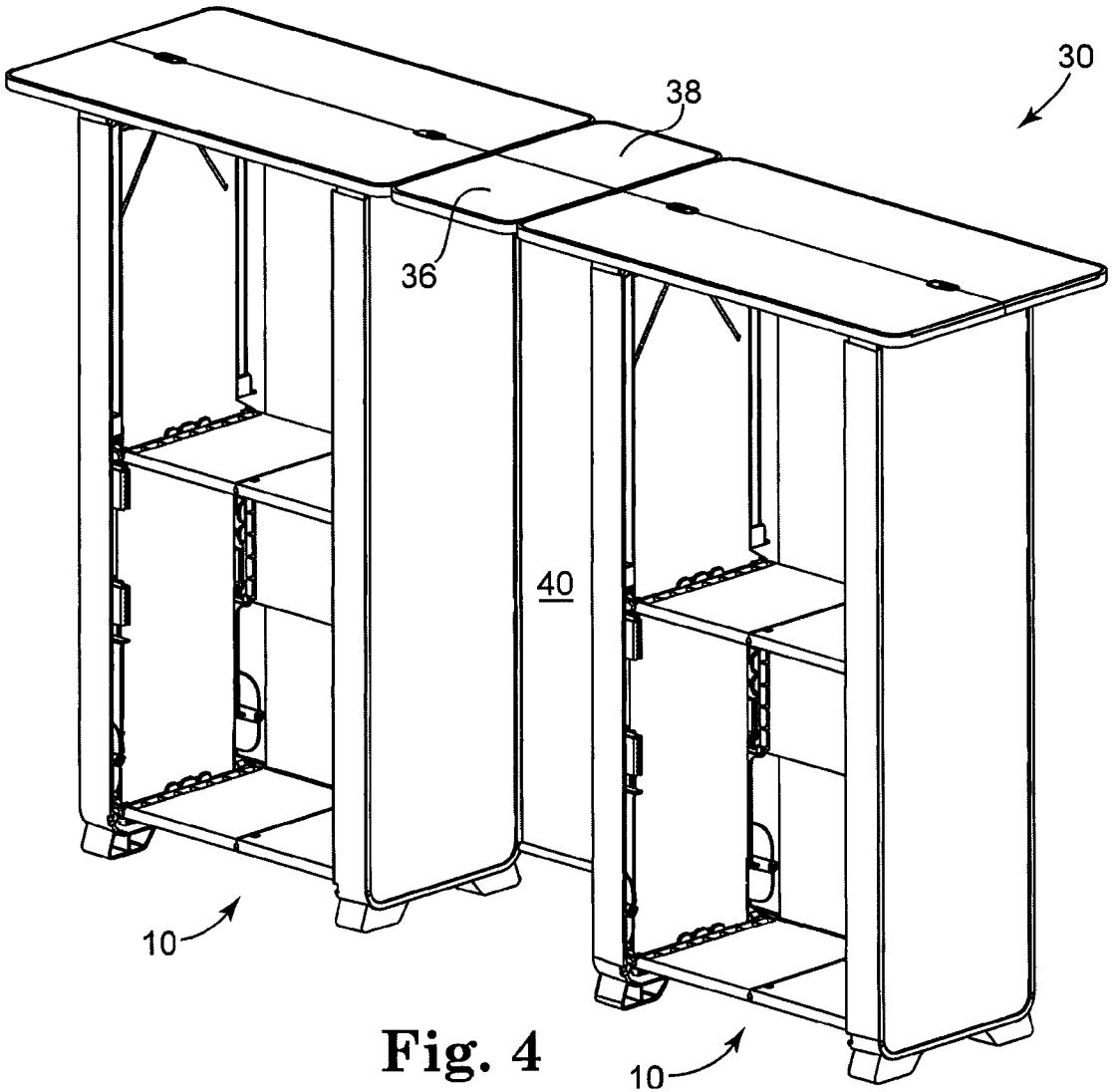
FIG. 4 is a top rear perspective view of the counter illustrated in FIG. 3.

When fully erected, the transaction table 10 is stable and provides a tabletop surface preferably at a standard countertop height or elevation. When fully collapsed, the transaction table 10 is compact and easily transportable. The transaction table 10 is preferably adaptable to a counter configuration as illustrated in FIGS. 3-4, by providing bridging members for connecting adjacent transaction tables to produce a continuous countertop surface of a desired length. Accordingly, it should be appreciated that the transaction table 10 is particularly suited for use in tradeshows and exhibitions due to its quick and easy setup and takedown (described later) while also providing a stable top surface, storage capacity, configuration flexibility and a clean aesthetically pleasing appearance—all in a lightweight, transportable construction.

The transaction table 10 preferably comprises a collapsible base unit 11 and a removable tabletop 20. The collapsible base unit 11 preferably comprises left and right endwalls 12, 14 preferably of sufficient length or height such that with the tabletop 20 is mounted thereon, the elevation of the tabletop 20 is at a typical countertop height. The base unit 11 also preferably comprises a removable front panel 16 and a removable rear panel 18. The front and rear panels 16, 18 are preferably flexible panels made of fabric or other suitable material and are sized such that when the panels are attached to the base unit 11 (discussed later), the panels are maintained taut and substantially wrinkle free so as to provide a clean, professional appearance.

The tabletop 20 preferably comprises two tabletop members 22, 24 removably but rigidly mountable to the upper ends of the endwalls 12, 14 (discussed later). The tabletop members 22, 24 along with other components (discussed later) are preferably stowable within the base unit 11 when in the fully collapsed transport configuration (also discussed later).

Referring now to FIGS. 3 and 4, two adjacent transaction tables 10 are shown connected with tabletop bridging members 36, 38 and a front bridging panel 40 to provide an elongated counter 30. It should be appreciated that multiple transaction tables 10 and multiple tabletop bridging members 36, 38 and front bridging panel 40 may be arranged to provide a counter 30 of any desired length. The tabletop bridging members 36, 38 and the front bridging panel 40 are also preferably stowable within the base unit 11 when in the fully collapsed transport configuration (also discussed later).

Figure 5:
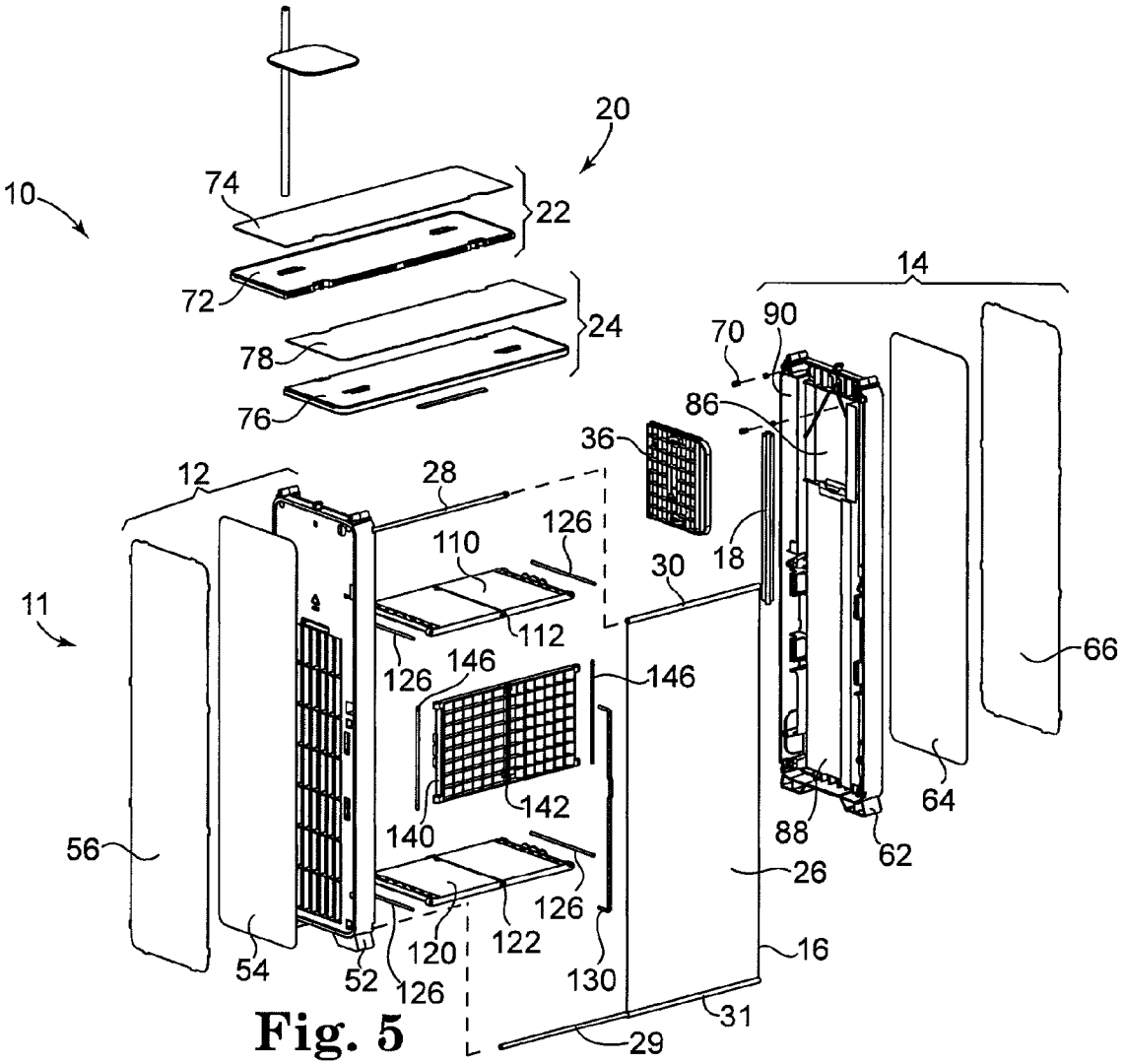
FIG. 5 is an exploded perspective view of the collapsible transaction table of FIG. 1.

FIG. 5 is an exploded perspective view of the transaction table 10 of FIG. 1 illustrating the preferred components comprising the base unit 11 and the tabletop 20. It should be appreciated that although certain components are shown exploded in FIG. 5 for purposes of describing the preferred construction of such components, these components are shown assembled in the other drawing figures as they would preferably appear to a user of the transaction table 10. For example, the left and right endwalls 12, 14 of the base unit 11 are preferably constructed of identical injection-molded thermoplastic wall shells 52, 62 to which are attached intermediate face panels 54, 64. Optional interchangeable graphic panels 56, 66 may also be provided to cover the face panels 54, 56 if a different appearance is desired. Magnets 70 are preferably received within rod receptacles 72 (FIGS. 16, 22) for magnetically securing the panel rods 28, 29 of the front and rear panels 16, 18 to the endwalls 12, 14 (discussed later). Similar, to the endwalls 12, 14, the tabletop members 22, 24 are preferably constructed of injection-molded thermoplastic top shells 72, 82 to which are attached top panels 74, 84. The top shells are preferably identical except that one of the shells preferably includes a tongue that is receivable within mating grooves of the other top shell (discussed later). The wall shells 52, 62 and the top shells 72, 82 preferably include internal ribbing typical of injection molding practices to reduce material while providing structural rigidity. The top panels 74, 84 and intermediate side panels 54, 64 may be a wood laminate or other desired panel material to provide the desired aesthetic appearance. It should also be appreciated that although injection molding is preferred for constructing the endwalls 12, 14 and tabletop members 22, 24, these components may be made of any suitable material and fabricated in any suitable manner.

As previously described, the front panel 16 (the rear panel 18 is shown rolled up in FIG. 5) preferably comprises a flexible panel 26. Upper and lower rods 28, 29 extend through upper and lower sleeves 30, 31, respectively.

Continuing to refer to FIG. 5, the collapsible body unit 11 preferably includes upper and lower folding horizontal shelves 110, 120 and a folding vertical panel 140. It should be appreciated that the vertical folding panel 140 provides lateral support and rigidity to the body 11 when in the fully extended position. As discussed in greater detail later when the steps of erecting and collapsing the base unit or described, each of the folding horizontal shelves 110, 120 and folding vertical panel 140 include a middle hinge 112, 122, 142 and each of the horizontal shelves 110, 120 and the vertical panel 140 is hingedly attached to the left and right endwalls 12, 14 by horizontal and vertical rods 126, 146 retained within the endwalls. The ends of the shelves 110, 120 pivot about the horizontal rods 126 as the shelves fold and unfold along their middle hinges 112, 122. Similarly, the ends of the vertical panel 140 pivot about the vertical rods 146 as the panel folds and unfolds along its middle hinge 142 as the base unit moves from the fully extended configuration (FIG. 9) to the fully collapsed transport configuration (FIG. 6). A coupling rod 130 is connects the upper and lower horizontal folding shelves 110, 120 so that the shelves preferably move in unison to create a more efficient folding and unfolding action when the body unit 11 is being collapsed and expanded.

Figure 20:
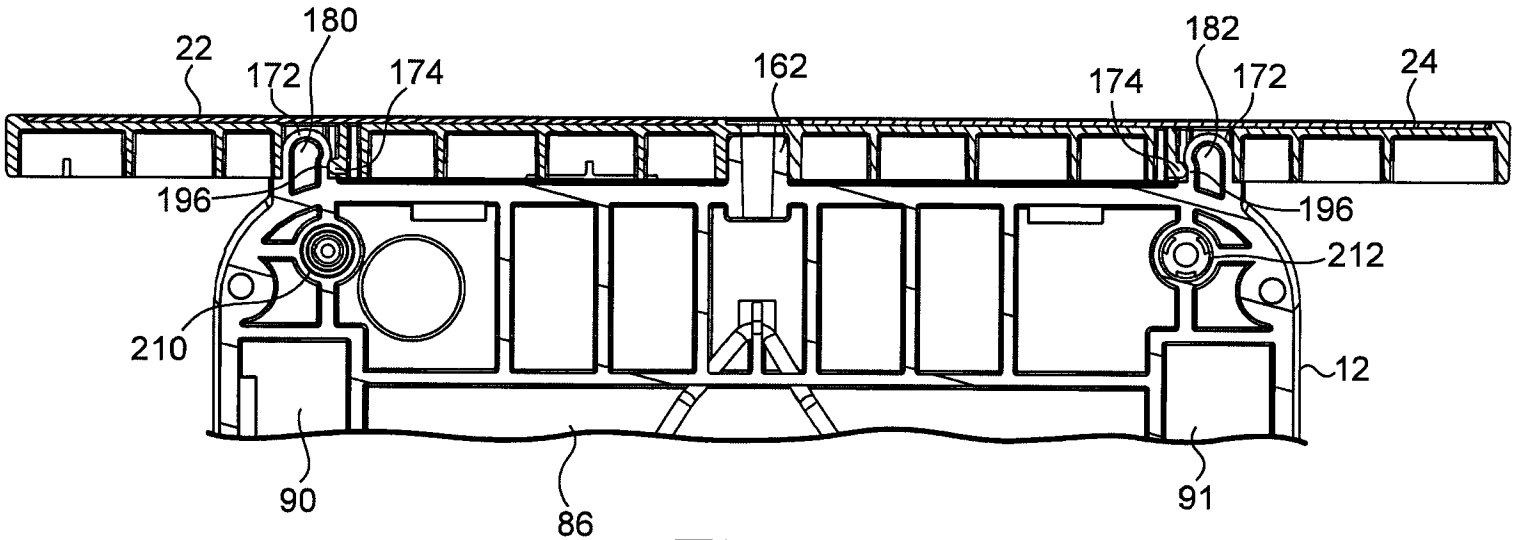
FIG. 20 is a cross-sectional view of the tabletop member as viewed along lines 20-20 of FIG. 1.

Referring to FIGS. 6-16, the preferred steps of erecting the base unit 11 from the fully collapsed position (FIG. 6) to the fully extended position (FIGS. 8 and 9) and the attachment of the panel members 16, 18 (FIGS. 15-16) are hereinafter described. Referring to FIG. 6, the endwalls 12, 14 are preferably snap-fit together by matingly aligned pegs and sockets 210, 212 (best illustrated in FIG. 20) preferably disposed near the four corners of the endwalls 12, 14 (only the upper corners are illustrated in FIG. 20). Thus, to expand the base unit 11, the user is preferably required to exert sufficient force to pry the endwalls apart to overcome the mechanical and/or frictional fit between the pegs 210 and sockets 212. Alternatively, or in addition to using a snap-fit connection, other connection methods may be utilized, including for example, providing magnets in the peg and socket areas 210, 212 or providing exterior clasps, buckles or straps or any other suitable means for removably securing the endwalls for transport.

Figure 7:
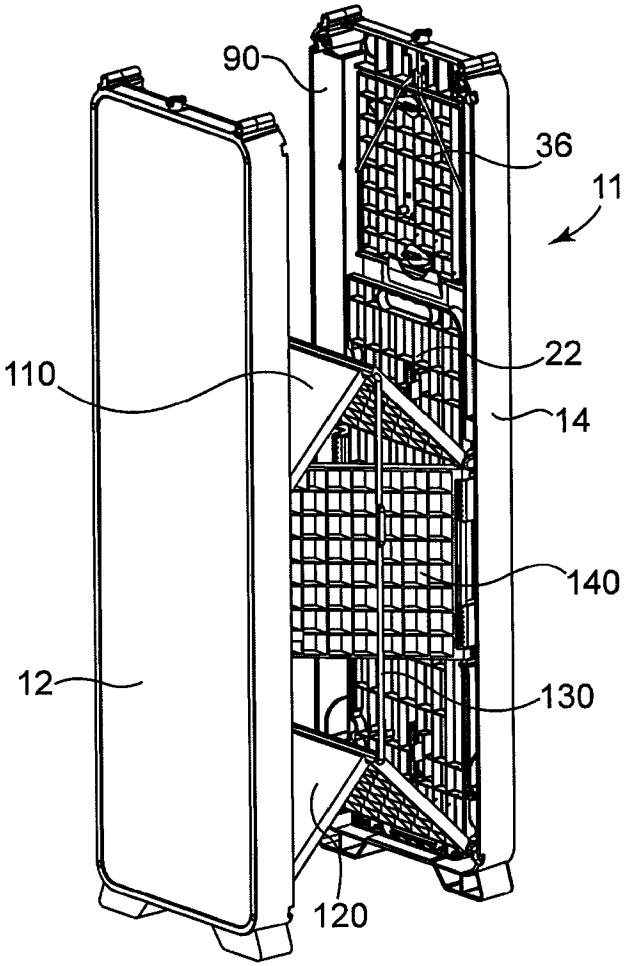
FIG. 7 is a top front perspective view of the transaction table base of FIG. 6 partially expanded position.
Figures 8, 10, 11, 12, 13, 14:
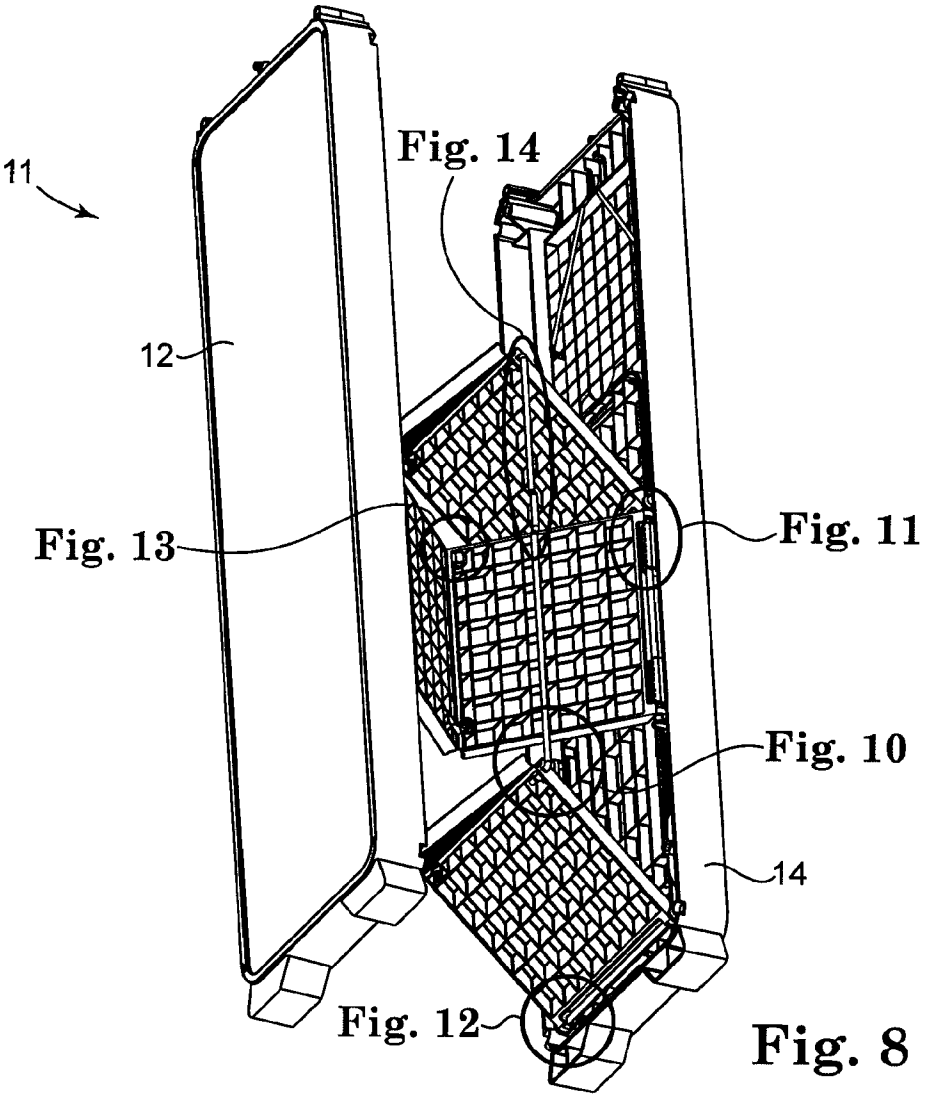
FIG. 8 is a bottom front perspective of the transaction table base of FIG. 7.
FIG. 10 is an enlarged view illustrating the coupling rod attachment to the collapsible shelf as shown in FIG. 9.
FIG. 11 is an enlarged view illustrating the hinge for the main cross support as shown in FIG. 9.
FIG. 12 is an enlarged view illustrating the hinge of the collapsible shelf as shown in FIG. 9.
FIG. 13 is an enlarged view illustrating the coupling rod clip as shown in FIG. 9.
FIG. 14 is an enlarged view illustrating the coupling rod as shown in FIG. 9 extending between support shelves.

Once the endwalls are disengaged, the endwalls are free to move outwardly as shown in FIGS. 7 and 8. As the endwalls are pushed or pulled outwardly, the upper and lower shelves 110, 120 simultaneously unfold due to the coupling rod 130 connecting the edges of those shelves as best illustrated in the enlarged details of FIGS. 10 and 14. Similarly, the outward movement of the endwalls causes the vertical panel 140 to unfold. The enlarged detail of FIG. 12 illustrates the preferred hinge attachment of the horizontal folding shelves 110, 120. The ends of the horizontal rod 126 are retained within horizontal rod supports 127 in the interior shell walls 52, 62 of each end member 12, 14. The ends of the shelves 110, 120 are pivotally disposed over the horizontal rods 126 by hooks 111, 121. Similarly, the ends of the vertical rod 146 are retained within a vertical rod supports 144 in the interior shell walls 52, 62 of each end member 12, 14. The projecting ends of the vertical rods 146 are received within slotted sockets 147 at the upper and lower edges of the vertical panel 140. FIG. 13 is an enlarged view of the coupling rod lock 148 which preferably frictionally receives the coupling rod 130 when the base unit 11 is in the fully extended position, to thereby removably lock the vertical panel 140 to the coupling rod 130 to preventing the vertical panel 140 from inadvertently folding and destabilizing the fully expanded base unit 11.

Figure 9:
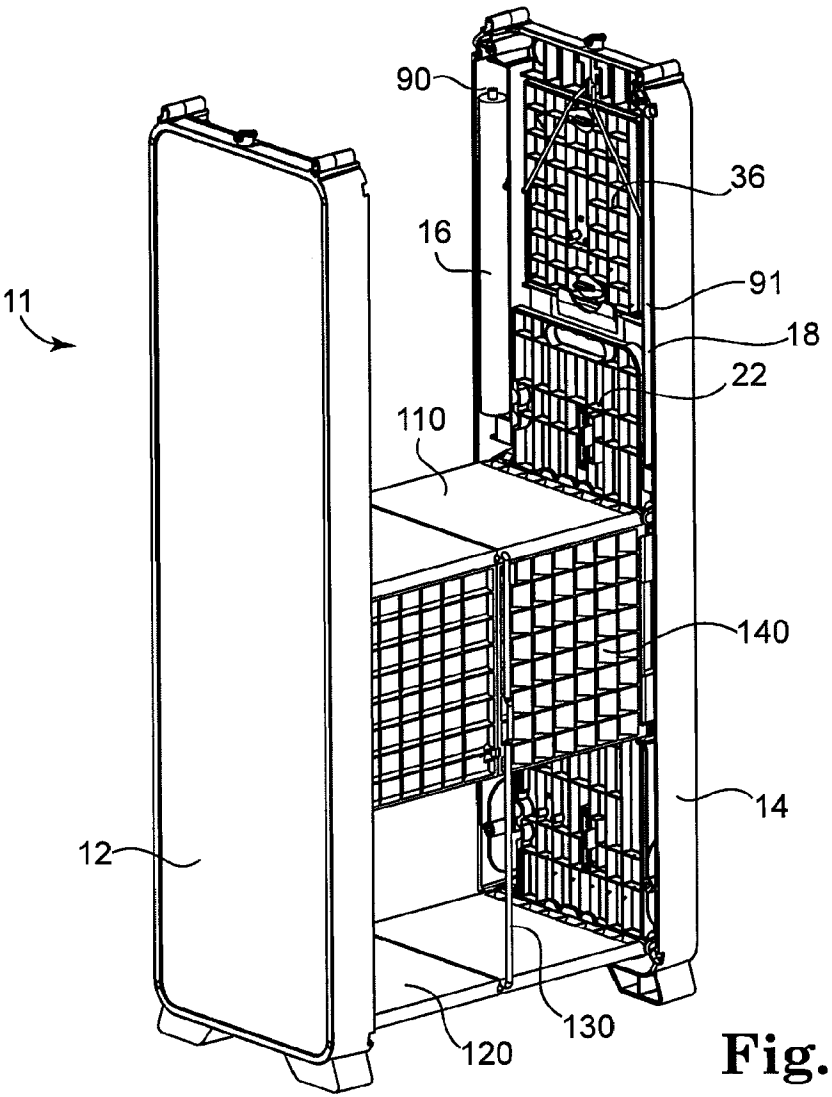
FIG. 9 is a top front perspective view of the transaction table base of FIG. 7 in the fully expanded position.
Figure 14:
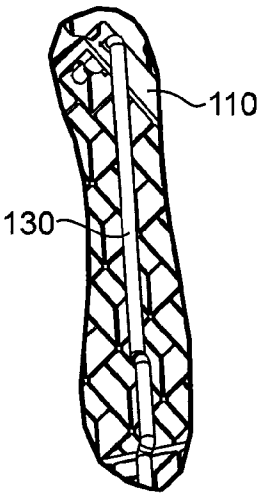
Figure 12:
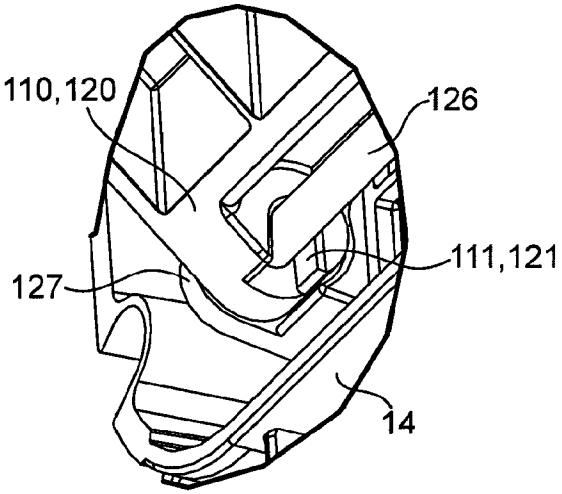
Figure 13:
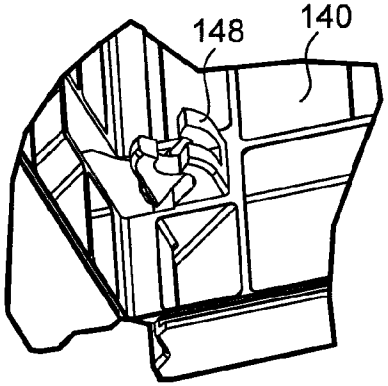
Figure 10:
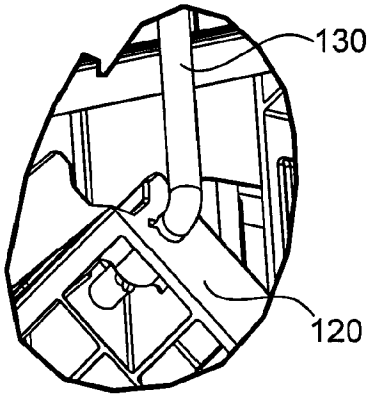
Figure 11:
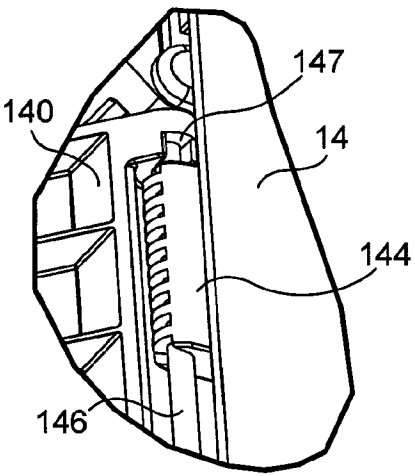

Referring to FIG. 9, with the base unit 11 in the fully extended position, the top bridging members 36, 38 can be removed (if desired for the counter configuration as shown in FIGS. 3-4) from the recesses 86 (see FIGS. 5 and 17) that are preferably formed in the respective sides of the opposing wall shells 52, 62. Additionally the tabletop members 22, 24 can be removed from the recesses 88 (see FIGS. 5 and 17) that are also preferably formed in the respective sides of the opposing wall shells 52, 62. Furthermore the rolled up front and rear panels 16, 18 and the rolled up bridging panel 40 may be removed from the recesses 90, 91 (see FIGS. 5 and 20) that are preferably formed in the respective sides of the opposing wall shells 52, 62.

Figure 16:
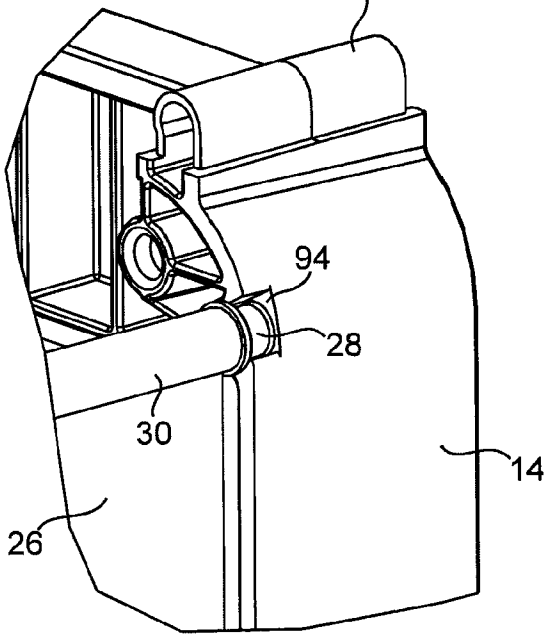
FIG. 16 is an enlarged perspective view of illustrating the connection of the front facing panel to the transaction table base as shown in FIG. 15.
Figure 15:
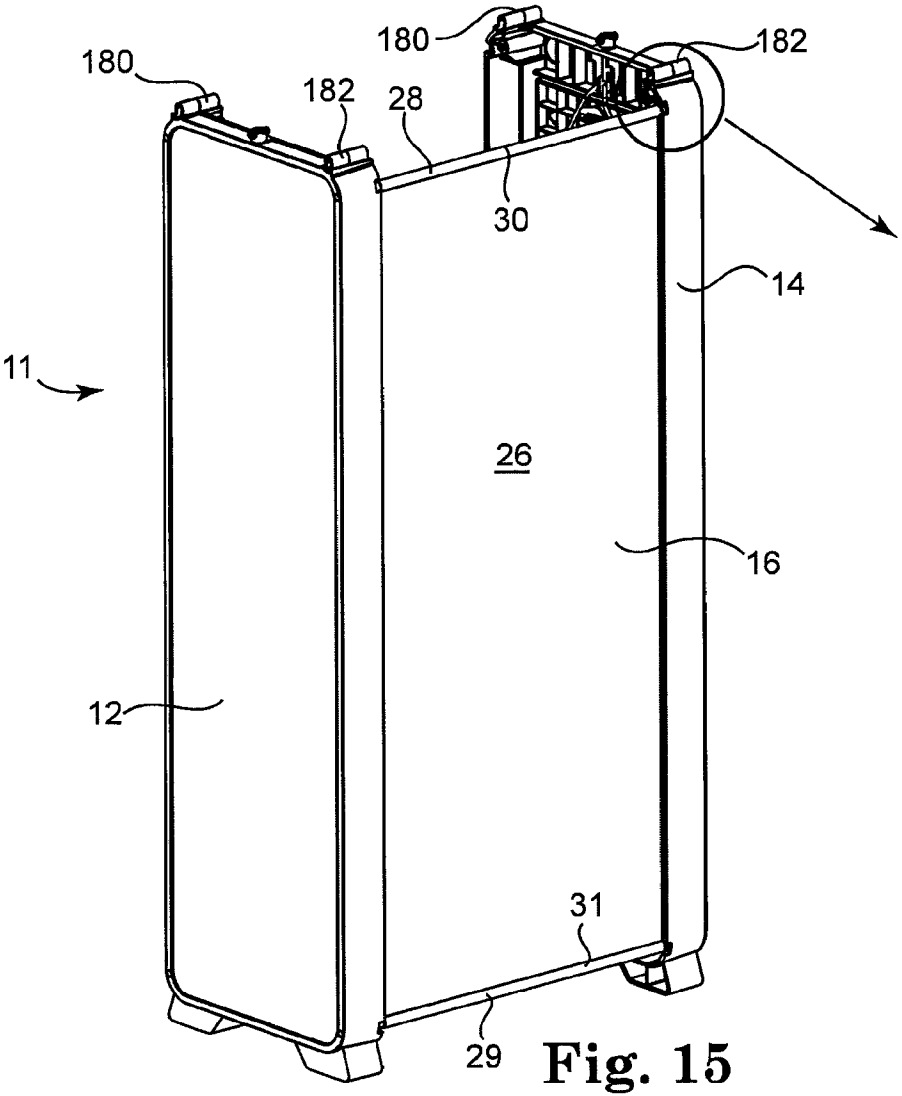
FIG. 15 is a top front perspective view of the transaction table base of FIG. 8 with a front facing panel installed.

FIGS. 15 and 16 illustrates the body unit 11 in the fully expanded position with the front panel 16 attached to the forward or front edge of the endwalls 12, 14. As best illustrated in FIG. 16 which is an enlarged detail of the area circled in FIG. 15, the ends of the upper rod 28 extend through upper sleeve 30 on the flexible panel 26. The rod 28 is preferably steel or other magnetically attractive material. The ends of the rod 28 are received within notches 94 formed in the front edge of the endwall 14. A similar notch is formed in the front edge of the opposing endwall 12. The same or similar rod retention construction is preferably provided to secure the lower rod 29 to the front edge of the end walls 12, 14. With the rods 28, 29 secured as described, the panels are maintained taut and substantially wrinkle free so as to provide a clean, professional appearance.

Figure 22:
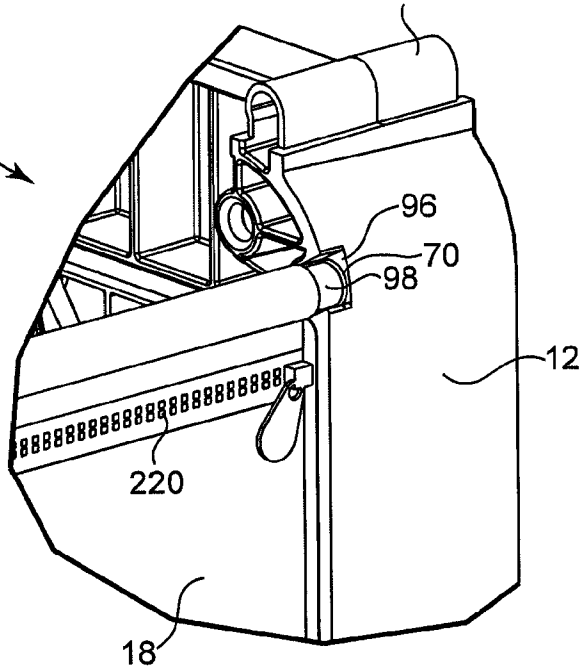
FIG. 22 is an enlarged perspective view illustrating the connection of the rear facing panel to the transaction table base as shown in FIG. 21.
Figure 21:
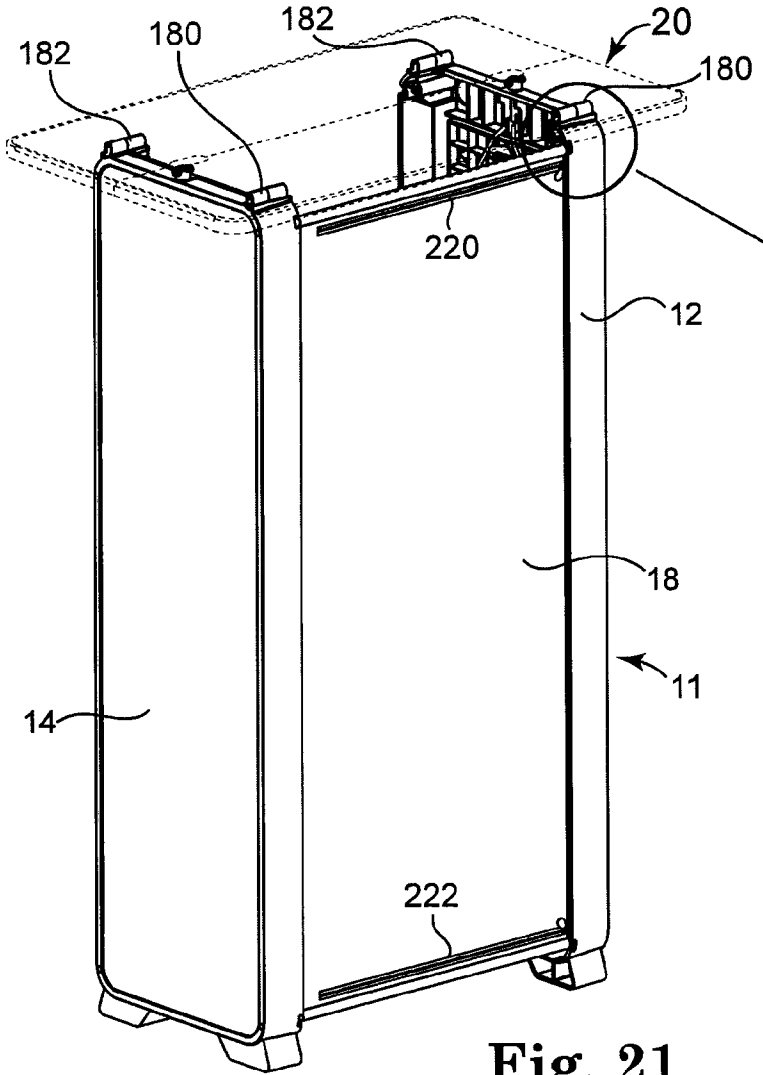
FIG. 21 is a top rear perspective view of the transaction table base of FIG. 8 with a rear facing panel installed.

FIGS. 21 and 22 illustrates the attachment of the rear panel 18 to the rearward or back edge of the endwalls 12, 14. The same or similar rod retention construction is used for the rear panel 18 as for the front panel 16. Note, however, as illustrated in FIGS. 21 and 22, the rear panel 18 preferably includes an upper and lower zipper 220, 222 to permit access to the interior storage area and shelves 110, 120 without removing the rods 98, 99 from the notches 96 formed in the back edge of the endwalls 12, 14.

Figure 18:
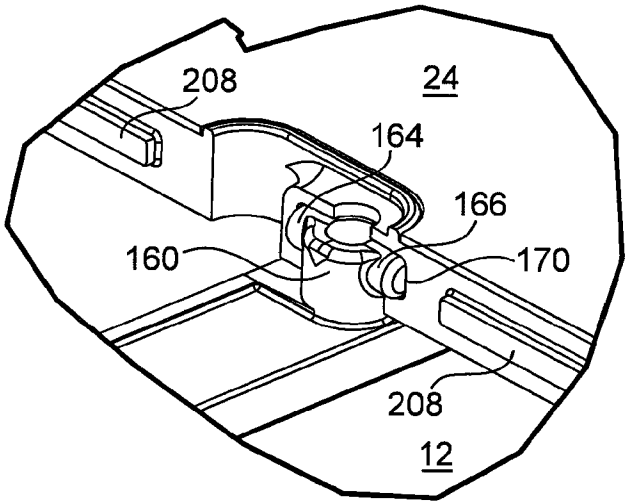
FIG. 18 is an enlarged perspective view of the tabletop coupling elements as shown in FIG. 17.
Figure 17:
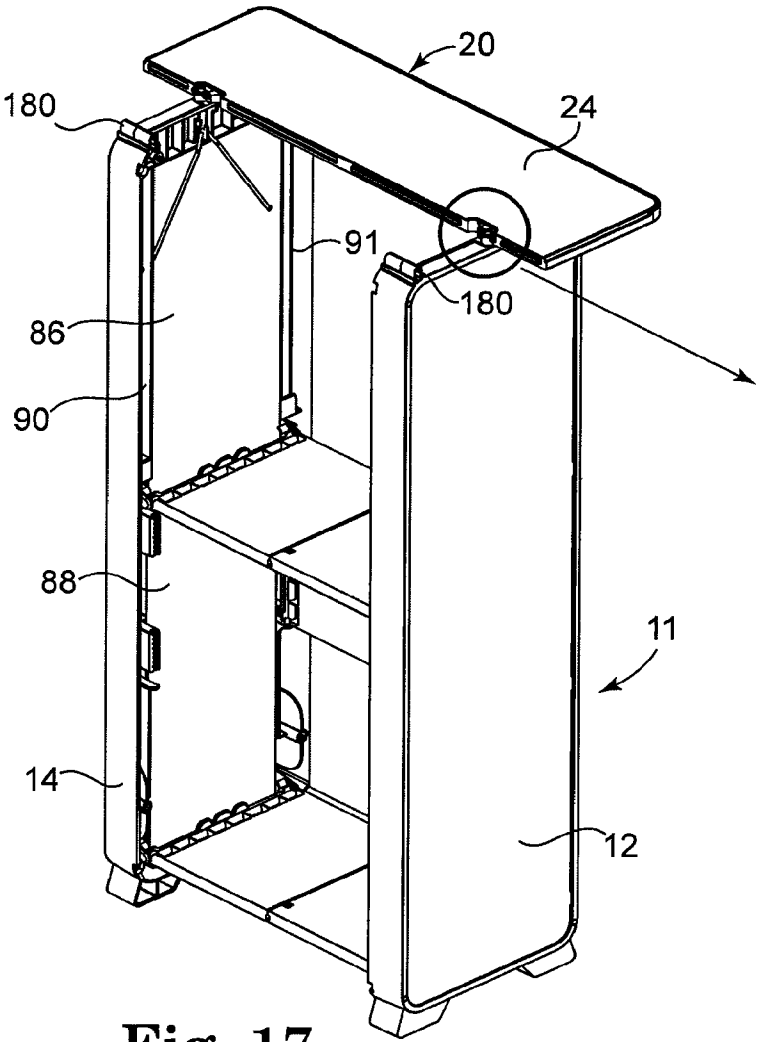
FIG. 17 is a top rear perspective view of the fully expanded transaction table base of FIG. 8 with a front tabletop member attached.

Referring to FIGS. 17-20 the preferred method of attaching the tabletop 20 to the base unit 11 is hereinafter described. FIG. 17 is a rear perspective view of the body unit 11 showing the front tabletop member 24 attached thereto. As will be discussed in further detail below, each endwall 12, 14 includes a number of attachment features on a top end thereof which are designed to rigidly yet removably secure the tabletop members 22, 24 to the base unit 11. Referring to FIG. 18, left endwall 12 preferably includes a central attachment upright 160. The central attachment upright 160 preferably includes a central cylindrical portion 162 extending in a substantially upright orientation from the top end of left endwall 12. Extending from opposite sides of central cylindrical portion 162 are a first extension 164 and a second extension 166. Each of the tabletop members 22, 24 include mating recesses 170 along their abutting ends to receive the opposite sides of the central attachment upright 160.

Figure 19:
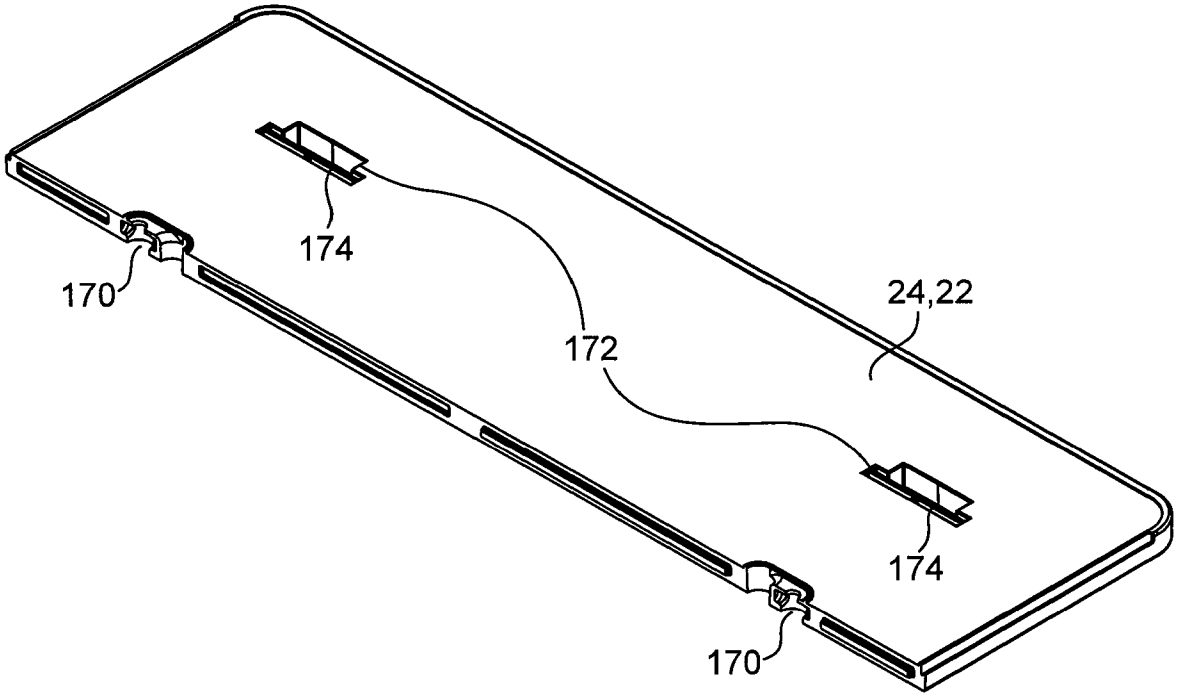
FIG. 19 is a top perspective view of one of the tabletop members with the top panel removed to better illustrate the slots which receive the top projections of the endwalls.

FIG. 19 is a bottom view of tabletop members 22, 24, which are preferably identical except that one of the tabletop members includes an edge with projecting tongues 208 (best illustrated in FIG. 18) which are receivable within mating grooves (not shown) in the abutting end of the other tabletop member. The recesses 170 configured to receive the central attachment upright 160 are provided in the abutting end of the left and right endwalls 12 and 14. In addition, the tabletop members 22, 24 include a pair of slots 172, configured to receive top projections 180, 182 (see FIGS. 15 and 21) on the top ends of the endwalls 12, 14.

FIG. 20 is an enlarged partial cross-sectional view of the tabletop 20 and base unit 11 as viewed along lines 20-20 of FIG. 1. The front top projections 182 and a rear top projections 180 are both illustrated in cross-section. The bottom surface slots 172 receive in the front and rear tabletop members 22, 24 receive the front and rear top projections 180, 182, respectively. The inward facing edge of the slots 172 preferably include a resilient displaceable detent 174 that engages inwardly facing ridges 196 on the top projections 180, 182 thereby providing a secure snap-fit connection.

Figure 24:
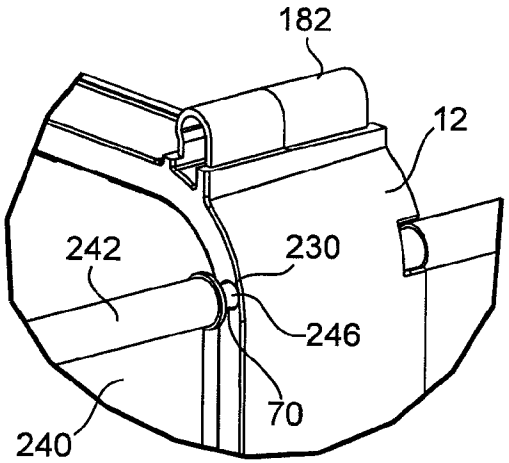
FIG. 24 is an enlarged perspective view illustrating the connection of the bridge facing element to the transaction table base as shown in FIG. 23.
Figure 23:
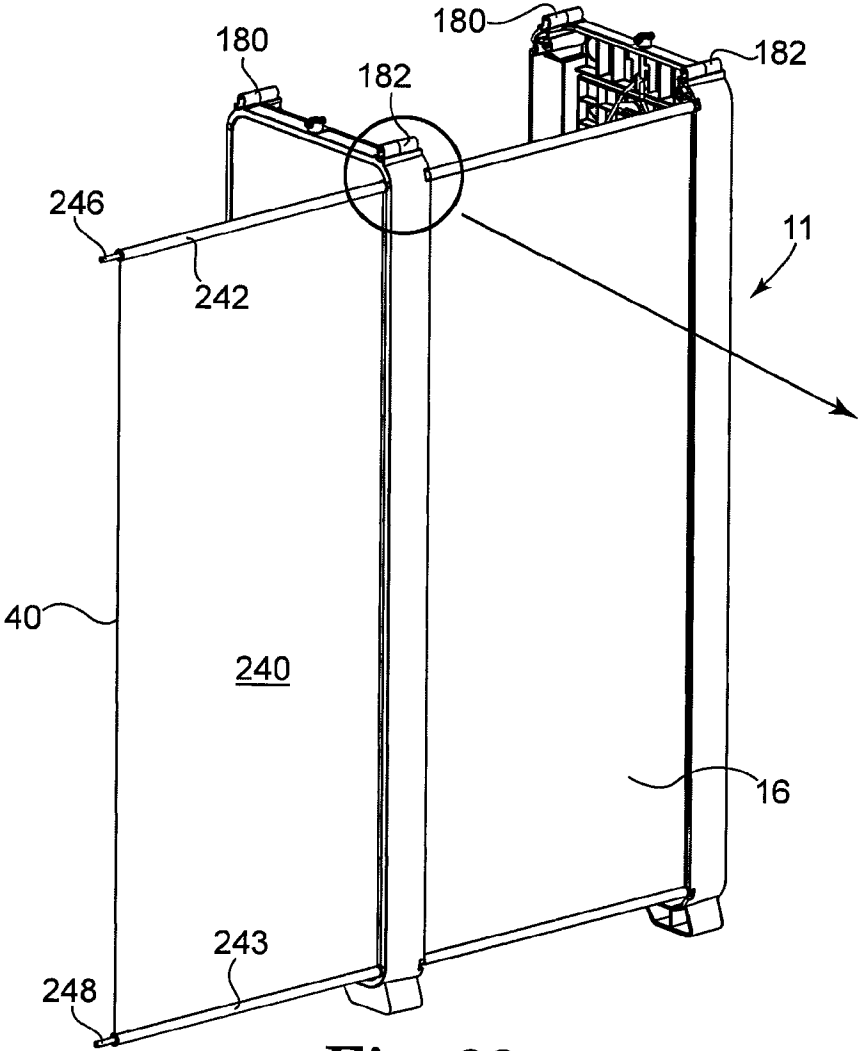
FIG. 23 is a top front perspective view of the transaction table base of FIG. 8 and illustrating a bridge facing element installed.

As generally discussed above with reference to FIGS. 3 and 4, a counter 30 can be created utilizing multiple transaction tables 10. Rather than simply stacking transaction tables 10 end-to-end, which would leave gaps between adjacent body units 11 due to the wider tabletops 20, it is preferably to provide top bridging members 36, 38 and a panel bridging member 40. Referring to FIGS. 23-24, bridging panel 40 preferably includes a flexible panel 240 having upper and lower sleeves 242, 243 to receive upper and lower rods 246, 248. The ends of the rods 246, 248 are preferably received within apertures 230 (FIG. 24) in the face of endwalls 12, 14. So that the transaction tables 10 do not have to be moved apart to insert the rods 246, 248 into the aligned apertures of adjacent transaction tables, one end of each rod 246, 248 preferably includes a spring loaded steel pin. Thus, to install the bridging panel 40, the end of the rod 246, 248 with the spring loaded steel pin is preferably inserted into one of the apertures 230 which preferably has a magnet 70 disposed therein. Force is exerted on the rod to compress the spring-loaded pin to reduce the length of the rod. With the other end of the rod aligned with the opposing aperture 230 in the adjacent transaction table, the compression force exerted on the rod is released permitting the spring biased pin to extend the rod to into the opposing aperture thereby spanning the gap between adjacent transaction tables. The same operation is preferably performed to secure the lower rod 248 between adjacent transaction tables.

Figures 25, 26:
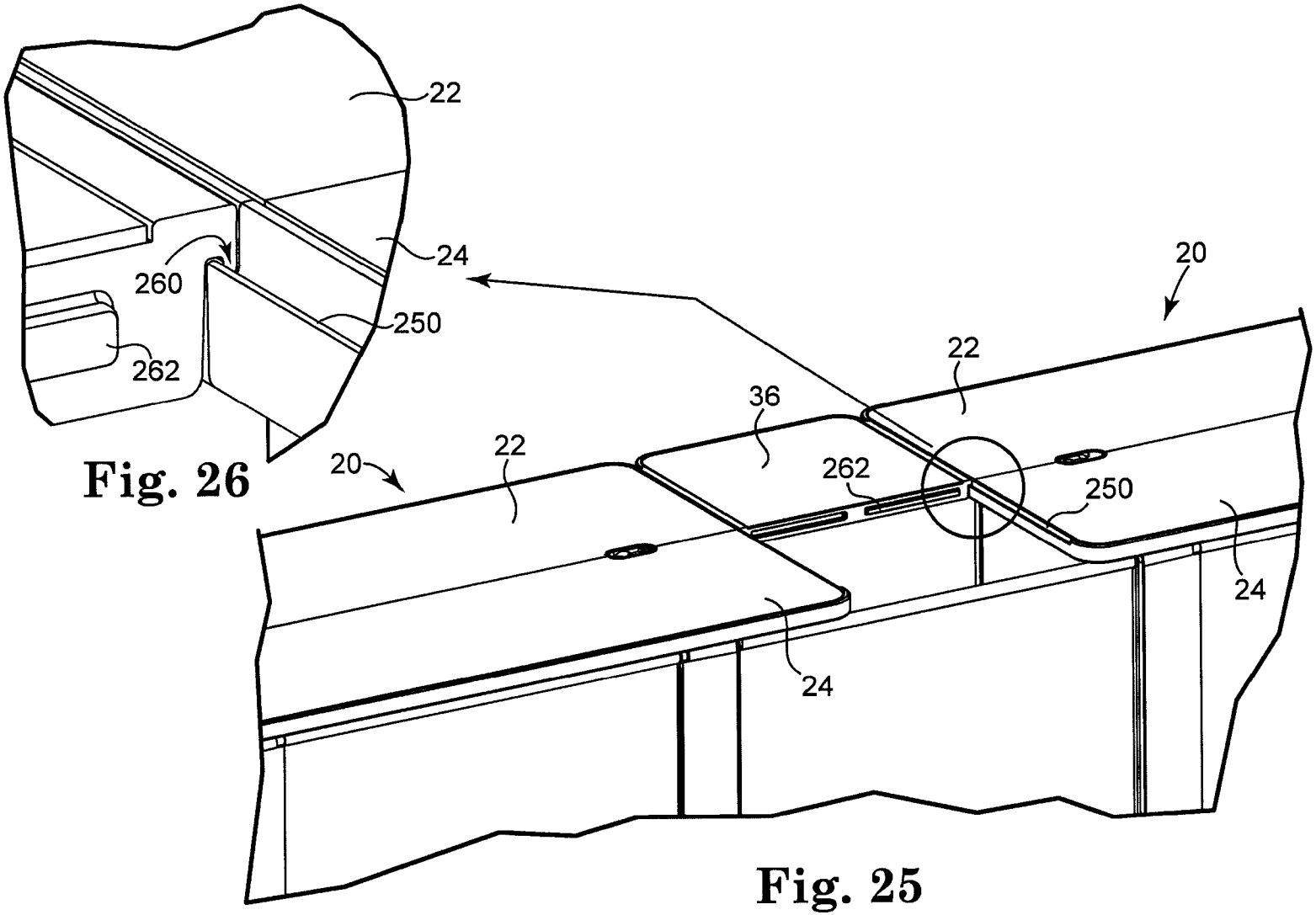
FIG. 25 is an enlarged perspective view of the counter of FIG. 3 illustrating the attachment of tabletop bridge components between adjacent collapsible transaction tables.
FIG. 26 is an enlarged perspective view illustrating the attachment of the tabletop bridge components as shown in FIG. 25.

Referring to FIGS. 25-28, the completion of counter 30 is accomplished by placing the front and rear top bridging members 36, 38 between adjacent tabletops 20. As best illustrated in FIG. 26 opposing ends of each tabletop 20 are preferably configured with an outwardly extending and upwardly projecting lip 250. The opposing ends of the top bridging members 36, 38 are preferably configured with a mating outwardly extending and downwardly extending hook 260 which receives the lip 250. The elevations of the lip and hook are configured such that the top surface of the top bridging members are substantially planar with the top surface of the adjacent tabletops 20. Also as best illustrated in FIG. 26, the mating edges of the top bridging members 36, 38 preferably include mating tongue and groove connections for added structural rigidity. As shown in FIG. 26, the rear bridging member 36 includes tongues 262 which would be received by aligned grooves (not shown) in the mating front bridging member 38.

Figures 27, 28:
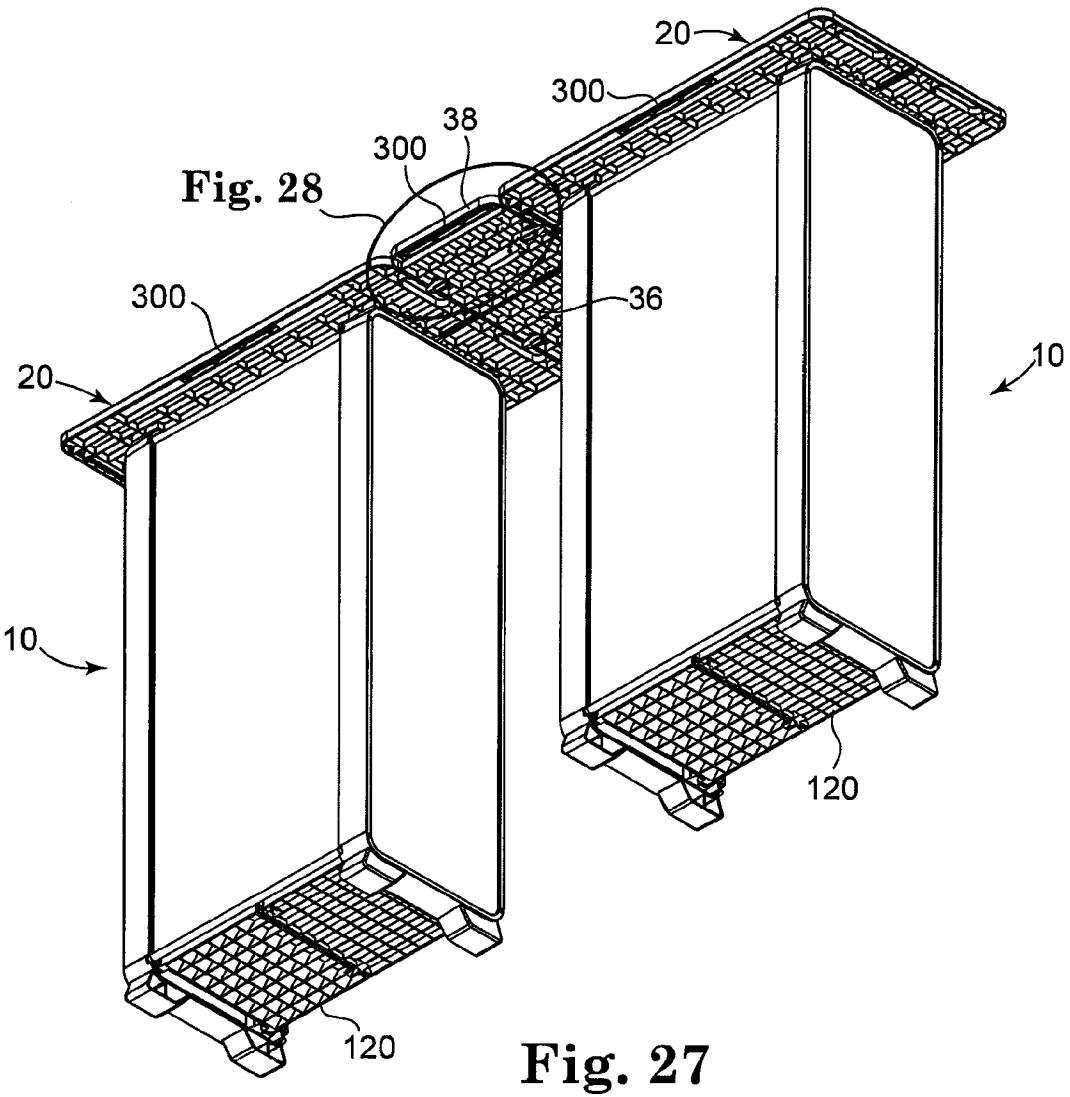
FIG. 27 is a bottom front perspective view of the counter of FIG. 3.
FIG. 28 is an enlarged bottom front perspective view illustrating the attachment and coupling of the tabletop bridge components to the table members of adjacent transaction tables as shown in FIG. 27.
Figure 28:
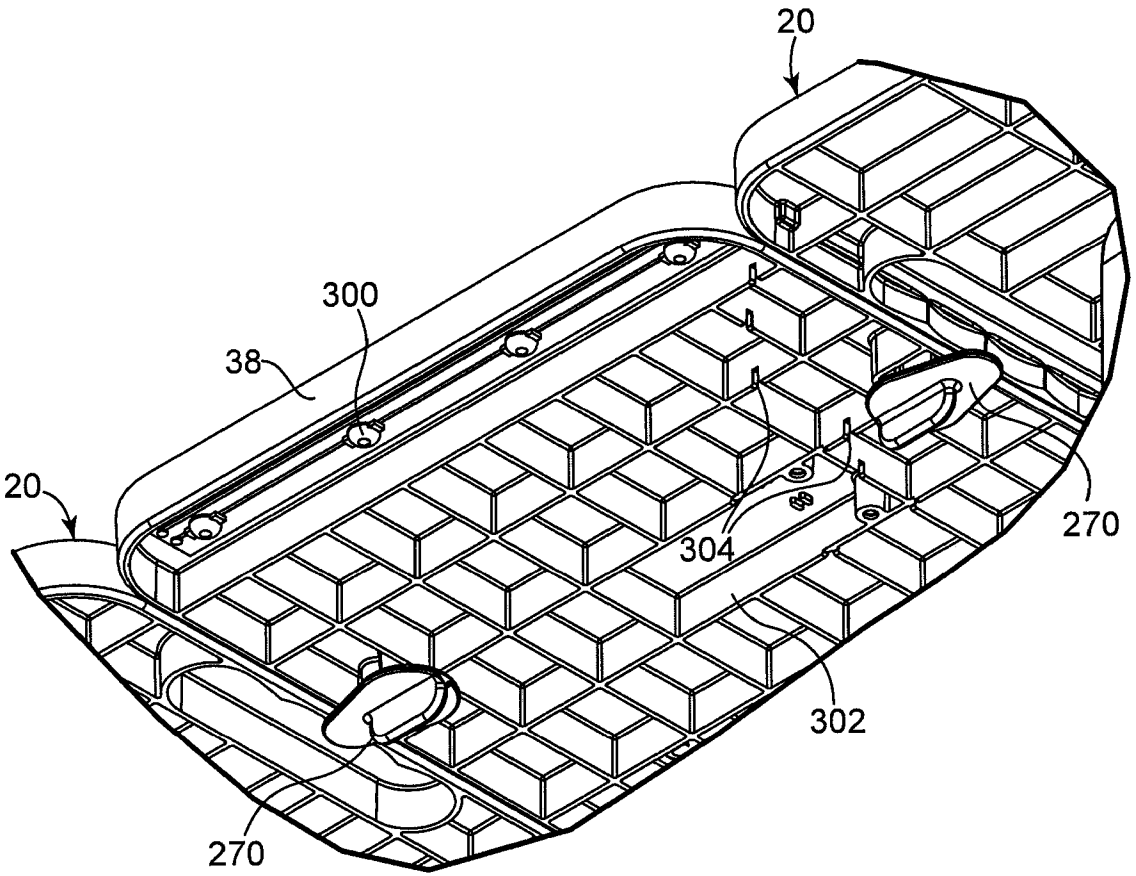

As illustrated in FIGS. 27 and 28, to secure the top bridging members 36, 38 to adjacent tabletops 20 to prevent them from inadvertently becoming dislodged and falling, the underside of the top bridging members 36, 38 preferably include rotatable locking tabs 270 (FIG. 28), that, when rotated, project beyond the edge of the bridging members 36, 38 to engage the underside of the adjacent tabletop 20 thereby locking the top bridging members 36, 38 in place.

The discussion above, and related figures, has described how counter 30 is formed by the addition of bridging members 36, 38. In the embodiments shown, counter 30 has been illustrated as an elongated straight counter, with bridging members 36, 38 each being substantially rectangular. It is contemplated that a curved or angled counter could similarity be configured by utilizing bridging members that have angled, curved or wedged shapes of different types. For example, a triangular bridging members could be used to cause two adjacent work tables to be coupled together forming an angled counter. Many different angled or curved configurations are contemplated, depending upon the particular needs for the counter.

Continuing to refer to FIG. 28, as an additional feature, the underside of the tabletop 20 and the top bridging members 36, 38 may include an LED light strip 300 to light the front panels 16 and bridging panels 40 if desired and/or to provide lighting on the backside of the transaction tables 10/counter 30 for illuminating the storage area. A compartment 302 is preferably formed in the underside of the bridging members 36, 38 for receiving a transformer (not shown) for the LED strip, or possibly a battery pack and switch (not shown), for powering the lighting strip 300. Electrical wires (not shown) extending from the compartment 302 may be routed through slots 304 in the ribbing of the members 36, 38. Similar lighting strips, compartments and ribbing slots may be provided in the underside of the tabletop members 22, 24.

Referring again to FIGS. 1, 5 and 18, the tabletop 20 may include apertures 400 for receiving posts 402 and display racks 404 or other appurtenances for displaying promotional items and/or for routing electrical cables or the like between the surface of the tabletop and the storage area and shelves 110, 120 below.

The foregoing description is presented to enable one of ordinary skill in the art to make and use the invention and is provided in the context of a patent application and its requirements. Various modifications to the preferred embodiment of the apparatus, and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. A collapsible transaction table, comprising:

a base having a first sidewall, a second sidewall, a folding horizontal shelf hingedly secured between the first sidewall and the second sidewall, and a folding vertical panel hingedly secured between the first sidewall and the second sidewall, the first sidewall and the second sidewall each having at least one recess therein the base movable between an expanded configuration and a collapsed configuration; and a tabletop removably coupled to an upper end of the first sidewall and the second sidewall when the base is in the expanded configuration to form a substantially smooth and substantially continuous upper surface, the tabletop further being stowable within the at least one recess in either the first sidewall or the second sidewall of the base; wherein the tabletop comprises a first tabletop portion and second tabletop portion which are separable but matable with one another to form the substantially continuous upper surface, the first sidewall and the second sidewall each include a pair of attachment tabs and an attachment upright on the upper end, and wherein the first tabletop portion and the second tabletop portion each includes a surface recess on a bottom side thereof for cooperating with one of the attachment tabs and a mating recess along an edge for cooperating with the attachment upright.

2. The transaction table of claim 1 wherein the at least one recess of the first sidewall and the second sidewall houses at least one of the first table top portion and the second tabletop portion.

3. The transaction table of claim 1 wherein the first tabletop portion and the second table top portion, along with the first sidewall and the second sidewall are configured to such that the attachment upright must first be coupled with the mating recess before it is possible to engage the respective surface recess and attachment tab, such configuration thereby substantially securing the first table portion and second portion.

4. The transaction table of claim 1 wherein the foldable shelf comprises a first planar portion and a second planar portion which are hingedly attached to one another, and wherein the first planar portion is hingedly attached to the first sidewall and the second planar portion is hingedly attached to the second sidewall.

5. The transaction table of claim 1 further comprising a flexible cover material removably attached between the first sidewall and the second sidewall when in the expanded configuration thereby creating a front facing panel, wherein the flexible cover paneling is storable within at least one sidewall when removed and the base is in the collapsed configuration.

6. The transaction table of claim 1 further comprising a second folding horizontal shelf hingedly secured between the first sidewall and the second sidewall, wherein the folding shelf and the second folding shelf are coupled to one another and substantially parallel.

7. The transaction table of claim 1 wherein the first tabletop portion and the second tabletop portion have an edge structure configured to support additional planar members.

8. A transaction counter formed by a plurality of transaction tables of claim 7, wherein the additional planar members further comprise a plurality of bridging elements supported by the first tabletop portions and the second tabletop portions of adjacent transaction tables, thereby forming an extended horizontal countertop.

9. The transaction counter of claim 8 further comprising a flexible bridging material removably attached below the bridging portions and between the sidewalls of adjacent transaction tables thereby creating a vertical facing panel concealing the space between adjacent transaction tables.

10. The transaction counter of claim 8 wherein the bridging elements have rotatable locking tabs configured to interact with the first and second tabletop portions to lock the bridging elements in place.

11. A collapsible transaction table capable of being configured in a collapsed self contained configuration and an expanded configuration, the table comprising:

a base unit having a first sidewall, a second sidewall, and a folding support structure coupled to the first sidewall and the second sidewall, the folding support structure further comprising a first hinged folding member hingedly attached between the first sidewall and the second sidewall, and a second hinged folding member hingedly attached between the first sidewall and the second sidewall, the first sidewall and second sidewall further having a plurality of attachment tabs and coupling structures extending from an upper surface;

a table top comprising a first top member and a second top member, wherein the first top member and the second top member are each substantially planar having an upper work surface and a lower coupling surface, the lower coupling surface having a plurality of attachment slots configured to receive the attachment tabs, the first top member and the second top member further having a central edge surface with a plurality of coupling recesses configured to interact with the coupling structure on the first sidewall and the coupling structure on the second sidewall; and a front facing member having a flexible material portion removably attachable between the first sidewall and the second sidewall when the transaction table is in its expanded configuration thereby creating a front facing panel for the transaction table.

12. The collapsible transaction table of claim 11 wherein the hinged folding members each further comprise a pair of panel members and a central hinge which allows the panel members to be folded such that the pair of panel members be juxtaposed with one another when in their folded configuration and be coplanar when in their extended position.

13. The transaction table of claim 11 wherein the coupling structures include a central attachment upright and the plurality of coupling recesses in the central edge surface of the first top member and the second top member are configured to receive the central attachment upright in an interlocking manner.

14. The transaction table of claim 13 wherein the coupling structures are configured such that the first top member and the second top member must first receive the central attachment uprights in the coupling recesses in order to allow the plurality of attachment tabs to be received in the attachment slots.

15. The transaction table of claim 11 wherein the first hinged folding member is a first folding shelf member having a substantially horizontal folding axis, and the second hinged folding member is a vertical folding panel having a substantially vertical folding axis.

16. The transaction table of claim 15 further comprising a second folding shelf member hingedly attached between the first sidewall and the second sidewall, with the second folding shelf being coupled to and parallel with the first folding shelf member thereby causing the first shelf member and the second shelf member to move in conjunction with one another.

17. A collapsible transaction counter capable of being configured in a shipping orientation and in a table orientation, comprising:

a first base unit and a second base unit, each base unit having a first sidewall, a second sidewall, and a folding support structure coupled to the first sidewall and the second sidewall, the folding support structure further comprising a first hinged folding member hingedly attached between the first sidewall and the second sidewall, and a second hinged folding member hingedly attached between the first sidewall and the second sidewall, the first sidewall and second sidewall further having a plurality of attachment tabs and coupling structures extending from an upper surface;

a first tabletop and a second tabletop, with each tabletop comprising a pair of top members which are each substantially planar having an upper work surface and a lower coupling surface, the lower coupling surface having a plurality of attachment slots configured to receive the attachment tabs, the first top member and the second top member further each having a central edge surface with a plurality of coupling recesses configured to interact with the coupling structures of the first sidewall and the second sidewall;

a first front facing member and a second front facing member, each having a flexible material portion removably attachable between the first sidewall and the second sidewall of the first and second base units when in the expanded configuration thereby creating front facing panels for the first base unit and the second base unit;

a first bridging element and a second bridging element, each configured to be coupled with the respective top members of the first tabletop and the second tabletop at opposite sides of the first and second bridging elements, thereby creating a continuous countertop made up of the first tabletop, second tabletop, first bridging element and second bridging element; and a bridge facing element removably coupled between the first base unit and the second base unit at a location below the first bridging element and the second bridging element to thereby create a facing between the first base unit and the second base unit which is substantially in line with the front facing panels of the first base unit and the second base unit.

18. The collapsible transaction counter of claim 17 wherein the bridging elements include a downward facing lip on opposite sides thereof and the pairs of tops each include an upward facing lip which receives and supports the downward facing lip.

19. The collapsible transaction counter of claim 18 wherein the bridging elements further include rotatable locking tabs for locking the bridging elements in place.

* * * * *